United States Patent [19]

Hastings et al.

[11] Patent Number: 4,543,710

[45] **Date of Patent: * Oct. 1, 1985**

[54] METHOD OF REDUCING CORONA DISCHARGE IN AN ELECTROSTATIC SPRAY GUN

[75] Inventors: Donald R. Hastings, Elyria; Glen A. Herstek, Lorain; Don R. Scarbrough, Elyria, all of Ohio

[73] Assignee: Nordson Corporation, Amherst, Ohio

[ * ] Notice: The portion of the term of this patent subsequent to Aug. 13, 2002 has been disclaimed.

[21] Appl. No.: 539,087

[22] Filed: Oct. 5, 1983

[51] Int. Cl.[4] ..... H01C 17/02

[52] U.S. Cl. ..... 29/613; 29/455 R; 29/458; 239/691; 427/230

[58] Field of Search ..... 29/455 R, 458, 460, 29/402.18, 402.04, 613, 614, 615; 239/690, 691; 427/230

[56] References Cited

U.S. PATENT DOCUMENTS 2,489,992 11/1949 Tucker ..... 29/455
4,182,490 1/1980 Kennon .
4,241,880 12/1980 Hastings .
4,273,293 6/1981 Hastings .
4,335,851 6/1982 Hastings .

FOREIGN PATENT DOCUMENTS 910820 11/1962 United Kingdom ..... 29/613

*Primary Examiner*—Howard N. Goldberg
*Assistant Examiner*—P. W. Echols
*Attorney, Agent, or Firm*—Wood, Herron & Evans

[57] ABSTRACT

A method of substantially eliminating corona discharge at the high-value resistor of an electrostatic spray gun comprises the steps of inserting an insulating tube within a bore formed in the gun barrel, positioning a high-value resistor in the insulating tube, filling a portion of the insulating tube with a slug of dielectric material such as grease and then inserting a high voltage cable into the insulating tube so as to force the grease ahead of the cable. The grease encapsulates the resistor and flows into the space between the insulating tube and bore in the gun barrel to eliminate the presence of air around the resistor so as to prevent corona discharge.

10 Claims, 2 Drawing Figures

METHOD OF REDUCING CORONA DISCHARGE IN AN ELECTROSTATIC SPRAY GUN

RELATED APPLICATIONS

This application is related to a co-pending application Ser. No. 539,086, filed Oct. 5, 1983 and entitled "Method & Apparatus for Replacing Dielectric Material at the High-Value Resistor of an Electrostatic Spray Gun to Prevent Corona Discharge", invented by Richard M. Simashkevich and William J. Sharp, which is assigned to the same assignee as this invention.

BACKGROUND OF THE INVENTION

This invention relates to electrostatic spray guns, and in particular a method for reducing corona discharge in the barrel of an electrostatic spray gun.

Conventional electrostatic spray guns project fluid coating material such as paint, varnish, lacquer and the like in atomized or particulate form toward an object to be coated. The object to be coated is held at electrically ground potential and an electric charge is imparted to the coating material so that it will be elctrostatically attracted to the object. In order to assure that a high percentage of the coating material ejected from the electrostatic spray gun is deposited on the object, high charging voltages, up to 120 kv, are typically applied to the coating material.

When spraying many of the coating materials in use today, including powders, a readily ignitable atmosphere results in the area of the coating operation. Energizing the high voltage electrostatic charging circuit associated with the spray gun causes energy to be capacitively stored in the electrically conductive components of the charging system. If the gun is brought too close to any grounded object, the possibility arises that a spark will jump between the high voltage circuit in the gun and the grounded object igniting the flammable atmosphere in the coating area. Many recent improvements in electrostatic spray guns have been directed to reducing incendevity resulting from the discharge of capacitively stored electrical energy, such as disclosed, for example, in U.S. Pat. Nos. 4,182,490; 4,241,880; 4,273,293; and 4,335,851, all assigned to the same Assignee as this invention.

One means of damping discharge of electrical energy capacitively stored in the charging circuit, disclosed in the prior patents mentioned above, is the provision of a high-value resistor in the barrel of the gun. The resistor is interposed between a high voltage cable carrying the electrical charge from a source, and a high voltage lead which communicates with the nozzle assembly of the gun in which the coating material is charged. The high-value resistor effectively reduces energy capacitively stored in the gun barrel when properly insulated.

It has been found, however, that if air is present in the area of the connection between the resistor and high voltage lead, a corona discharge can occur which attacks such high voltage connection and the surrounding housing of the gun barrel. In order to eliminate air around the high voltage connection between resistor and lead, it has been the practice in the prior art to completely cover the resistor with a dielectric material such as grease. According to this method, the resistor is first encapsulated with grease and then inserted into a bore formed in the gun barrel so that it contacts the high voltage lead. In some instances, additional grease is placed in the gun barrel bore prior to insertion of the resistor. This method of eliminating air gaps around the resistor and providing an uninterrupted layer of non-conductive grease between the resistor and the gun barrel, and around the high voltage connection between the resistor and lead, has not been entirely effective.

SUMMARY OF THE INVENTION

This invention is directed to an improved method of encapsulating the high-value resistor in the barrel of an electrostatic spray gun to eliminate air gaps in the area of the resistor thereby preventing corona discharge.

According to the method of this invention, an insulating tube is inserted within a bore formed in the electrostatic gun barrel. The outside diameter of the tube is slightly less than the inside diameter of the bore so as to form a gap therebetween. A high voltage lead is disposed at the inner end of the bore, and a fitting is connected to the gun barrel at the outer end of the bore. A high-value resistor having a compliant contact such as a spring at one end is inserted into the insulating tube so that it contacts the high voltage lead. The resistor and spring are not covered with grease at this point, and are surrounded with air contained in the insulating tube. A quantity or slug of flowable, dielectric material such as grease is then deposited in the insulating tube at its outer end adjacent the fitting. A high voltage cable, which carries the electrical charge to be applied to the coating material, is next inserted through the fitting and into contact with the grease in the insulating tube. The cable tightly fits within the insulating tube so that it pushes the grease ahead toward the resistor and spring. The cable is advanced until its leading end contacts the spring which urges the resistor against the high voltage lead. The cable is then connected to the fitting to retain it in place within the insulating tube.

The grease is forced by the cable over and around the spring and resistor, completely encapsulating both elements. A sufficient quantity of grease is provided so that the spring and resistor are entirely encapsulated and at least a portion of the grease is forced into the gap between the insulating tube and bore in the gun barrel. This assures that all of the air in the area of the resistor is forced ahead of the grease into the gap between the insulating tube and bore, away from the resistor. The grease effectively insulates the resistor and its connection to the high voltage lead to eliminate corona discharge thereat.

DESCRIPTION OF THE DRAWINGS

The structure, operation and advantages of this invention will become further apparent upon consideration of the following description taken in conjunction with the accompanying drawings wherein.

DETAILED DESCRIPTION OF THE INVENTION

Figure 1:
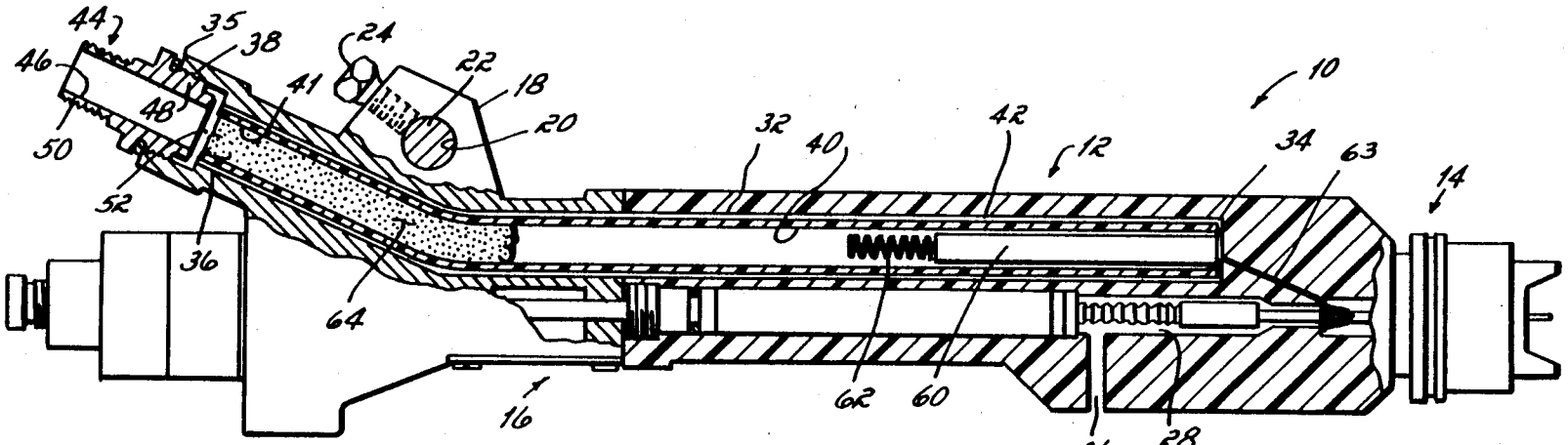
FIG. 1 is an axial cross-sectional view, partially in elevation, of an electrostatic spray gun having an insulating tube according to this invention.

The electrostatic spray gun 10 shown in the drawings is an air operated gun in which a stream of air impacts a stream of liquid coating to effect atomization of the liquid stream. Spray gun 10 includes a barrel assembly 12, a nozzle assembly 14 and an air delivery assembly 16. A flange 18 extends outwardly from the barrel assembly 12 and is formed with a bore 20 adapted to fit over an electrically grounded mounting rod 22. A set screw 24 extends through the flange 18 into locking engagement with the mounting rod 22 so as to mount the spray gun 10 in a desired position therealong.

Paint or some other spray coating material, which may be in the nature of a coating, varnish or lacquer, is supplied to the gun 10 under pressure from an external reservoir or tank (not shown) through an inlet port 26. The paint enters a longitudinal passageway 28 and travels to the nozzle assembly 14 where it is combined with an air stream supplied by the air delivery assembly 16. Just prior to or at the same time the paint is ejected from the nozzle assembly 14, a high voltage electrostatic charge is applied to the paint so that it is attracted to the object to be coated. The high voltage electrical energy is transmitted to the nozzle assembly 14 via an electrostatic charging circuit discussed in more detail below. A detailed description of the structure and operation of the barrel assembly 12, nozzle assembly 14 and air delivery assembly 16 may be found in U.S. Pat. No. 4,335,851, which is incorporated by reference herein.

An axially extending bore 32 is formed in the barrel assembly 12 having an inner end 34, and an outer end 36 which is spaced from the exterior surface 35 of the barrel assembly 12. A threaded bore 38, having a larger diameter than bore 32, extends from the outer end 36 of bore 32 to the exterior surface 35 of barrel assembly 12. An insulating tube 40, formed of plastic or another dielectric material, is inserted within the bore 32 and extends along its entire length terminating with an outer end 41. The insulating tube 40 has an outside diameter which is preferably about 0.050 inch smaller than the inside diameter of the bore 32 forming a gap 42 therebetween. A fitting 44 is provided having a central bore 46 and threaded male sections 48, 50 at opposite ends. The threaded section 48 of fitting 44 is adapted to be tightened within the threaded bore 38 in the barrel assembly 12, forming a space 52 between the outer end 41 of the insulating tube 40 and fitting 44. The gap 42 between the insulating tube 40 and bore 32 extends from the inner end 34 of bore 32 and terminates at the space 52.

As discussed above, the spray gun 10 includes a high voltage electrostatic charging circuit for applying an electrostatic charge to the paint to be applied to an object. The charging circuit comprises, in part, a high voltage cable 54, a resistor 60 having a compliant contact such as a coil spring 62 attached at one end, and a high voltage lead 63. The high voltage cable 54, connected to a source of electrical energy (not shown), is adapted to be inserted through the fitting 44 and into the insulating tube 40 within barrel assembly 12. An electrically conductive disk 56 is attached to the end of cable 54 inserted within the insulating tube 40, and a rotatable female fitting 58 is mounted to the outer surface of cable 54 at a location spaced from the disk 56. The high voltage lead 63 is mounted within the barrel assembly 12 and one end enters the bore 32 at its inner end 34 and extends into the insulating tube 40. In order to damp the discharge of electrical energy capacitively stored in the barrel assembly 12 and cable 54, the resistor 60 and coil spring 62 are disposed within the insulating tube 40 and connected in series between the high voltage lead 63 and cable 54. In the assembled position of cable 54 within insulating tube 40, discussed in more detail below, the disk 56 contacts coil spring 62 and urges resistor 60 into electrical contact with the high voltage lead 63. The remainder of the high voltage electrostatic charging circuit conveys the electrical charge from lead 63 to the nozzle assembly 14, and is discussed in detail in U.S. Pat. No. 4,335,851.

The high charging voltage carried by cable 54, which may be on the order of 120 kv, can result in corona discharge between the resistor 60, its high voltage connections to cable 54 and lead 63, and the surrounding area of the barrel assembly 12, if no insulation is provided therebetween. The presence of air within bore 32 in the area of resistor 60 permits a corona discharge that can seriously deteriorate the barrel assembly 12 and the high voltage connections over a period of time. It has been recognized that a coating of grease around the resistor 60, coil spring 62 and their connections to cable 54 and lead 63 provides effective insulation and prevents corona discharge. However, prior efforts to obtain a continuous coating or encapsulation of the resistor 60 and coil spring 62 with grease have not been entirely successful.

In accordance with the method of this invention, the resistor 60 and coil spring 62 are completely encapsulated with grease and no pockets of air are left in the area between the resistor 60 and barrel assembly 12 so that corona discharge is eliminated. The insulating tube 40 is first inserted within the bore 32 of barrel assembly 12 with the gap 42 of about 0.050 inch provided therebetween. The resistor 60 is then inserted into the insulating tube 40 so that one end contacts the high voltage lead 63 and the end attached to coil spring 62 faces toward the outer end 36 of bore 32. At this point, no grease or other dielectric substance has been applied to the resistor 60 or coil spring 62 and only air is contained within the insulating tube 40 and gap 42 between the gun barrel bore 32 and insulating tube 40.

A quantity or slug of a grease 64 sufficient to fully encapsulate the resistor 60 and coil spring 62 is filled or injected into a portion of the insulating tube 40, flush with its outer end 41. In a standard Model AN-9 electrostatic spray gun, manufactured and sold by the Assignee of this invention, the quantity of grease 64 needed to fully encase the resistor 60 and coil spring 62 is preferably about 7.8 to 8.2 cubic centimeters. In the AN-9 Model electrostatic spray gun, 7.8 to 8.2 cc of grease 64 extends about 3 inches into the insulating tube 40 from its outer end 41. Of course, electrostatic spray guns having larger or smaller gun barrel dimensions, and gun barrel bores, would require different quantities of grease to fully encapsulate the high-value resistor and spring. The Assignee's Model AN-9 gun, and the quantity of grease 64 it requires, are discussed herein to illustrate the method of this invention.

Once the slug of grease 64 is in place at the outer end 41 of insulating tube 40, the threaded male section 48 of fitting 44 is tightened within the threaded bore 38 in the barrel assembly 12. Preferably, an O-ring seal 68 is disposed between the fitting 44 and threaded bore 38 to provide a fluid tight seal therebetween. Although a threaded connection between fitting 44 and bore 38 is shown herein, it is contemplated that other fluid-tight connections therebetween such as standard quick-disconnect connections could also be used.

The final step of the method herein is the insertion of cable 54 into the insulating tube 40 so that the conductive disk 56 at its inward end contacts the coil spring 62 and urges the resistor 60 into contact with the high voltage lead 63. In addition to completing the high voltage electrostatic charging circuit of the spray gun 10, insertion of the cable 54 into the insulating tube 40 forces the slug of grease 64 ahead of the cable 54 so that the grease 64 encases both the coil spring 62 and resistor 60. Preferably, the cable 54 tightly fits within the insulating tube 40 with a clearance therebetween of only approximately 0.005 inch. Thus, as the cable 54 moves within insulating tube 40, the grease 64 forces any air within the insulating tube 40 between the resistor 60 and insulating tube 40, and then outwardly into the gap 42 between insulating tube 40 and the barrel assembly bore 32. The cable 54 is locked in place within insulating tube 40 by the female fitting 58, mounted to the exterior cover of cable 54, which is rotatable so as to tighten over the threaded male section 52 of the fitting 44. Preferably, an O-ring (not shown) or metal-to-metal seal is provided between female fitting 58 and the barrel assembly fitting 44.

Figure 2:
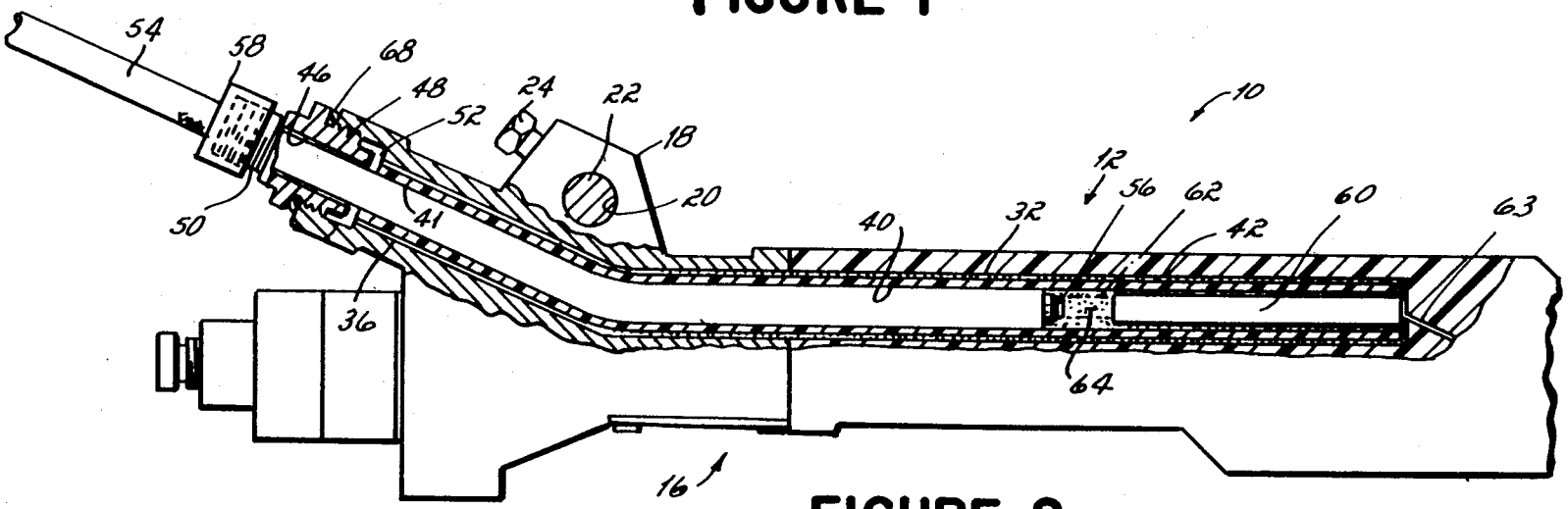
FIG. 2 is a view of the electrostatic spray gun shown in FIG. 1 with the high voltage cable inserted within the insulating tube to encapsulate the resistor with grease.

It has been found that corona discharge in prior art electrostatic spray guns occurs most commonly at the high voltage connections between the high-valued resistor and the cable and lead. Deterioration by corona attack of such high voltage connections, and the barrel assembly in the vicinity of such connections, has been a pervasive problem. An important aspect of this invention is that the resistor 60 and coil spring 62 are completely encapsulated with grease 64, particularly at their connections to cable 54 and lead 63. As shown in FIG. 2, the slug of grease 64 provided is more than required to completely encapsulate the spring 62 and resistor 60. Excess grease 64 is forced between the exterior of the resistor 60 and interior of the insulating tube 40 into the gap 42 between the insulating tube 40 and bore 32 in barrel assembly 12. The grease 64 is forced around the forward edge of the resistor 60 and flows upstream within the gap 42 toward the outer end 41 of insulating tube 40. Any air which was initially between the resistor 60 and insulating tube 40, or in the gap 42, is thus effectively forced upstream along the gap 42.

Preferably, the central bore 46 of fitting 44 has an interior diameter about 0.030 inch greater than the exterior diameter of cable 54. This enables at least part of the air trapped within the gap 42 to flow into the space 52 between fitting 44 and insulating tube 40, and then outwardly from the spray gun 10 through the central bore 46 of the fitting 44 along the side the cable 54.

The method of insulating the resistor 60 and coil spring 62 of spray gun 10 according to this invention thus provides for the elimination of air pockets at the high voltage connections with cable 54 and lead 63 to prevent corona discharge thereat. A continuous layer of grease 64 encapsulates both the resistor 60 and coil spring 62, and at least some of the grease 64 is forced between the resistor 60 and insulating tube 40, around the forward end of resistor 60 which contacts lead 63, and into the gap 42 between the insulating tube 40 and gun barrel bore 32. In this manner, all air is purged from the vicinity of the resistor 60 and only an insulating layer of grease 64 remains.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A method of preventing corona discharge in the area of a high-value resistor of an electrostatic spray gun, comprising the steps of:

inserting an insulating tube within a bore formed in the spray gun;

positioning a resistor within said insulating tube;

filling at least a portion of said insulating tube with a quantity of flowable, dielectric material;

inserting a high voltage cable into said insulating tube so as to force said dielectric material ahead of said cable, said resistor being encapsulated with said dielectric material.

2. The method of claim 1 in which said insulating tube is of smaller outside diameter than the inside diameter of said bore forming a gap therebetween.

3. The method of claim 2 further including the step of:

forcing a portion of said nonconductive material between said resistor and said insulating tube, and into said gap between said insulating tube and said bore.

4. The method of claim 1 in which said resistor is connected to an electrically conductive lead, said cable being adapted to form said dielectric material to encapsulate said connection between said resistor and electrically conductive lead so as to prevent corona discharge thereat.

5. The method of claim 1 in which said flowable, dielectric material is grease.

6. The method of claim 1 in which a quantity of approximately 7.8 to 8.2 cubic centimeters of said dielectric material is filled into said insulating tube.

7. The method of claim 1 in which said resistor includes a compliant contact attached at one end thereof, said compliant contact being encapsulated with said dielectric material.

8. A method of preventing corona discharge in the area of a high-value resistor disposed in the barrel of an electrostatic spray gun comprising the steps of:

inserting an insulating tube within a bore formed in said barrel of said spray gun, said insulating tube having a smaller outside diameter than the inside diameter of said bore forming a gap therebetween;

positioning said high-valued resistor at one end of said insulating tube in electrical contact with an electrically conductive lead;

filling a portion of the other end of said insulating tube with a slug of grease; and inserting a high voltage cable into said other end of said insulating tube to force said grease ahead of said cable, said grease encapsulating said resistor and said connection to said electrically conductive lead so as to prevent corona discharge thereat.

9. The method of claim 8 further comprising the step of:

forcing a portion of said grease between said resistor and insulating tube and into said gap between said insulating tube and said bore.

10. The method of claim 8 in which said resistor includes a spring mounted at one end thereof, said cable engaging said spring to urge said resistor into contact with said lead, said method further comprising the step of:

encapsulating said spring and said connection between said cable and said spring with said grease.

* * * * *